United States Patent [19]

Yeager et al.

[11] 4,437,542

[45] Mar. 20, 1984

[54] ACOUSTICAL WALL PANEL AND MOUNTING SYSTEM

[75] Inventors: Raymond W. Yeager, Pataskala; Mark R. Weitzman, Toledo, both of Ohio

[73] Assignee: Owens-Corning Fiberglas Corporation, Toledo, Ohio

[21] Appl. No.: 410,797

[22] Filed: Aug. 23, 1982

[51] Int. Cl.[3] ..... E04B 1/82

[52] U.S. Cl. ..... 181/290; 181/293; 181/294; 52/144

[58] Field of Search ..... 181/284, 290, 293–295, 181/291; 52/144, 145

[56] References Cited

U.S. PATENT DOCUMENTS

| | | | |
|---|---|---|---|
| 1,910,628 | 5/1933 | Nash | 181/290 X |
| 2,124,086 | 7/1938 | Slidell | 181/290 |
| 2,996,138 | 8/1961 | Schwartz et al. | 181/284 |
| 3,783,969 | 1/1974 | Pall | 181/286 |
| 3,919,444 | 11/1975 | Shayman | 181/290 X |
| 4,077,491 | 3/1978 | Hankel | 181/290 |

*Primary Examiner*—Benjamin R. Fuller

[57] ABSTRACT

An acoustical wall panel includes an elongated sound absorbent board faced with a needle-punched non-woven fabric provided with a woven scrim backing and having linear ribs extending longitudinally of the panel. Such panels are mounted by generally H-shaped splines concealed by the panels. The lofted texture of the fabric and the linear ribs help conceal a seam between two panels.

19 Claims, 4 Drawing Figures

ACOUSTICAL WALL PANEL AND MOUNTING SYSTEM

TECHNICAL FIELD

This invention relates generally to acoustical wall panels, and more particularly to a wall panel construction and mounting system wherein abutting mounted panels present an apparently seamless joint.

BACKGROUND ART

Prior to this invention, joints between abutting mounted fabric-faced acoustical wall panels were clearly visible.

DISCLOSURE OF THE INVENTION

In accordance with the invention, fabric covered acoustical wall panels are constructed and mounted in such a manner that joint seams between abutting panels are substantially invisible.

BEST MODE OF CARRYING OUT THE INVENTION

Figure 1:
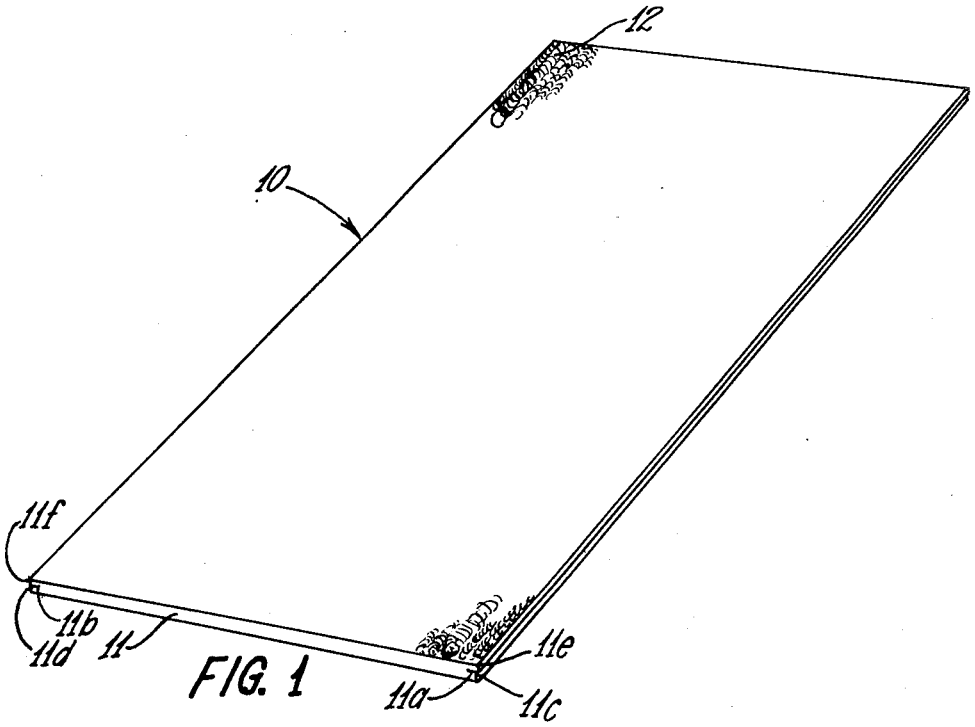
FIG. 1 is a perspective view of an acoustical wall panel constructed in accordance with the invention.

With reference to the drawings, FIG. 1 shows an acoustical wall panel 10 constructed in accordance with the invention and including a board 11 and a facing 12. Preferably the board 11 is a sound absorbent fibrous glass board having a thickness of about one inch, a density of about six pounds per cubic foot, and an NRC (noise reduction coeffficient) of 0.75. The board may be nine or ten feet high and two or four feet wide.

In accordance with a preferred embodiment of the invention, the facing 12 adhered to the board 11 is a non-woven needle-punched fabric provided with a woven scrim backing for stability and ease of handling. The fabric is made of polyester or polypropylene staple fibers. A loose mass of intermingled fibers goes through a first needle—punching operation to densify the mass, interlock the fibers, and produce a needled matt about three-sixteenths of an inch in thickness. A woven-scrim backing of the same kind of fibers is applied to the needled matt in a second needle-punching operation. The scrim-backed matt is then passed through a third needle-punching operation wherein the pattern of needles in the needle board is such that a random linearly ribbed surface is formed on the front face with raised ribs of at least two different sizes randomly spaced and grouped, as best shown in the photographs of FIGS. 3 and 4.

Figure 2:
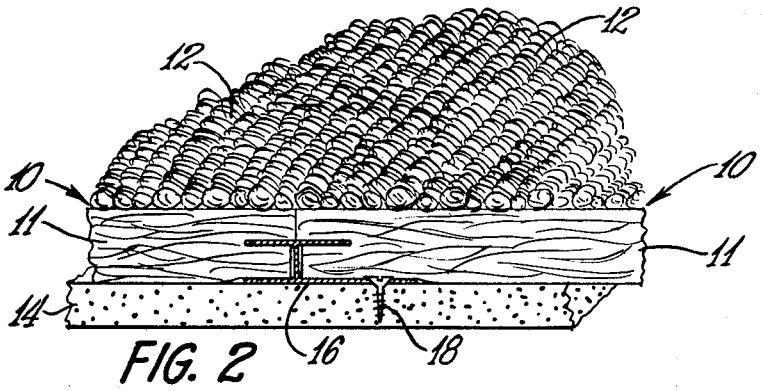
FIG. 2 is a fragmentary perspective view of a joint between two abutting mounted panels constructed in accordance with the invention.

FIG. 2 fragmentarily shows a pair of the panels 10 mounted on a sheet of drywall 14 forming a part of a wall. The panels are held by an extruded generally H-shaped spline 16 secured normally in a vertically extending position to the drywall 14 by screws 18, only one of which is shown. Opposite normally vertical edges of the boards 11 are kerfed to receive portions of the splines 16, only one of which is shown at the illustrated joint. The rear portions of the boards 11 are cut back along their normally vertical edges, in order that they can be received in the spline 16 with clearance from the central web portion thereof. This insures that the front portions of the boards 11 outside of the spline 16 can be tightly abutted, in order that the facings 12 of the two panels 10 can conceal the seam.

Figure 3:
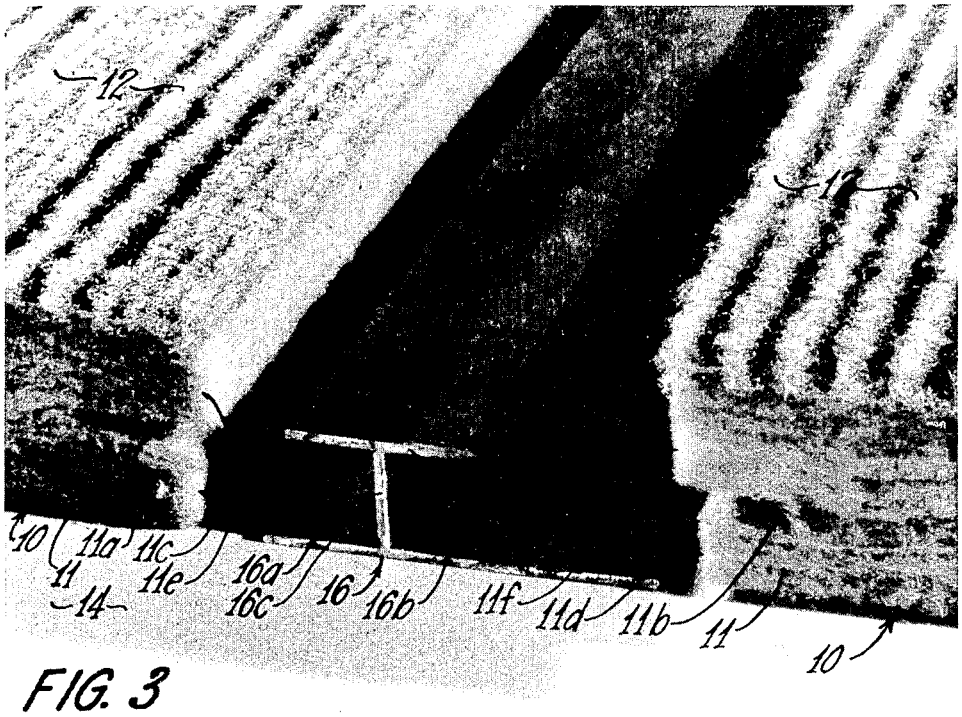
FIG. 3 is a photograph corresponding to a fragmentary exploded perspective view of a mounting spline and two acoustical wall panels constructed in accordance with the invention.

FIG. 3 fragmentarily shows a pair of the panels 10 in spaced relationship with a spline 16 therebetween. The board 11 of the left-hand panel 10 is provided with an oversized kerf **11*a* along a normally vertical edge for receiving a leg 16*a* of the spline 16 with clearance, while the board 11 of the right-hand panel 10 is provided with an oversized kerf 11*b* along a normally vertical edge for receiving a leg 16*b* of the spline 16 with clearance. In order that front edge portions 11*e* and 11*f* of the boards 11 and the facings 12 thereon can be tightly abutted, rear edge portions 11*c* and 11*d* of the boards are cut away to provide clearance for a central web portion 16*c* of the spline 16**.

Figure 4:
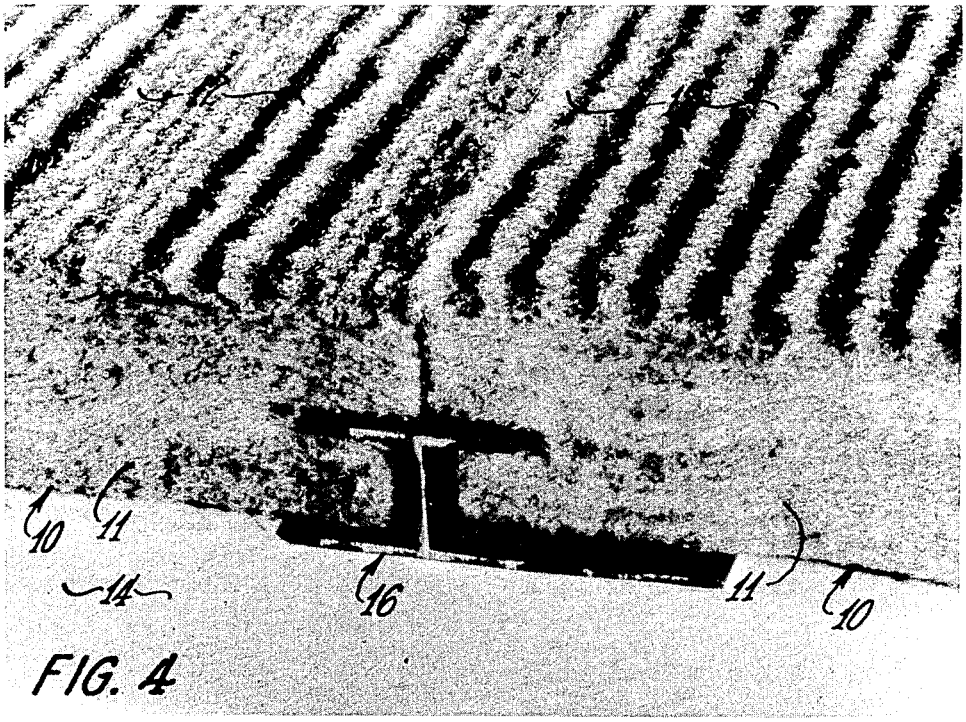
FIG. 4 is a photograph similar to the drawing of FIG. 2.

FIG. 4 shows the items of FIG. 3 assembled on a drywall sheet 14 forming part of a wall. It will be noted that no seam shows at the front faces of the two panels 10, and this is so even though the facings 12 are cut flush with front edge portions **11*e* and 11*f* of the boards 11**.

Several things contribute to the concealment of the seam between mounted panels 10, as follows:

a. The cutting away of the rear edge portions **11*c* and 11*d* of the boards 11 to enable tight abutment of the front edge portions 11*e* and 11*f***.

b. The alignment of the panels 10 by the spline 16 maintaining the front faces of the panels 10 in a single plane at the joint.

c. The ribs on the facing 12 extending in the same direction as the seam.

d. The different sizes of the ribs and the random grouping and spacing of the different-sized ribs, creating "visual noise", or the visual equivalent of masking sound.

e. The density and thickness of the facings 12 enabling meshing of surface fibers as the boards 11 of the panels 10 are tightly abutted at the front edge portions **11*e* and 11*f***.

While the splines 16 and elongated panels 10 are normally mounted vertically on a wall, they may be mounted horizontally, and could even be mounted angularly to a horizontal or vertical reference line.

Various modifications may be made in the structure shown and described without departing from the scope of the invention as set forth in the following claims.

We claim:

1. An acoustical treatment for a wall comprising an elongated generally H-shaped spline mounted on the wall in parallel relationship thereto and a pair of elongated generally rectangular sound absorbent panels mounted on the wall in cooperative engagement with said spline respectively on opposite sides thereof and in abutting relationship with each other at front longitudinal edge portions thereof, the longitudinal edge portions of said panels being provided with kerfs for respectively receiving portions of said spline, each of said panels having a fabric adhered to a front face thereof and cut flush with the longitudinal edge portions thereof but nevertheless concealing the joint between the abutting front longitudinal edge portions, the fabric being formed of non-woven staple fibers needle-punched in a first needle-punching operation, the fabric having linear ribs formed in another needle-punching operation, and the ribs extending longitudinally of the mounted panels.

2. An acoustical treatment as claimed in claim 1 wherein the ribs of said fabric are generally of at least two different sizes, one size being wider and more raised than the other.

3. An acoustical treatment as claimed in claim 2 wherein the different sized ribs are non-uniformly distributed.

4. An acoustical treatment as claimed in claim 1 wherein the fabric is provided with a woven scrim backing.

5. An acoustical treatment as claimed in claim 4 wherein the woven scrim backing is attached to the fabric in yet another needle-punching operation performed before the forming of the ribs.

6. An acoustical treatment as claimed in claim 1 wherein rear longitudinal edge portions of the panels are relieved to provide clearance for a central web portion of the spline and enable the front longitudinal edge portions to be tightly abutted.

7. An acoustical wall panel comprising an elongated generally rectangular sound absorbent fabricated fibrous board provided with a kerf along a longitudinal edge portion for receiving a portion of an elongated mounting spline and a fabric adhered to a front face of said board and cut flush with said longitudinal edge portion, the fabric being formed of non-woven staple fibers needle-punched in a first needle-punching operation, the fabric having linear ribs formed in another needle-punching operation, and the ribs extending longitudinally of the board.

8. A panel as claimed in claim 7 wherein the ribs of said fabric are generally of at least two different sizes, one size being wider and more raised than the other.

9. A panel as claimed in claim 8 wherein the different sized ribs are non-uniformly distributed.

10. A panel as claimed in claim 7 including a woven scrim backing on the fabric.

11. A panel as claimed in claim 10 wherein the woven scrim backing is attached to the fabric in yet another needle-punching operation performed before the forming of the ribs.

12. A panel as claimed in claim 7 wherein said longitudinal edge portion of the board is relieved to the rear to said kerf to provide clearance for a central web portion of a generally H-shaped mounting spline.

13. An acoustical wall panel comprising an elongated generally rectangular sound absorbent fabricated fibrous board, and a fabric adhered to a front face of said board, said fabric being formed of non-woven staple fibers needle-punched in a first needle-punching operation and having raised linear ribs thereon formed in another needle-punching operation, the ribs extending longitudinally of the panel.

14. A panel as claimed in claim 13 wherein the ribs of said fabric are generally of at least two different sizes, one size being wider and more raised than the other.

15. A panel as claimed in claim 14 wherein the different sized ribs are non-uniformly distributed across the width of the panel.

16. A panel as claimed in claim 13 including a woven scrim backing on the fabric.

17. A panel as claimed in claim 16 wherein the woven scrim backing is attached to the fabric in yet another needle-punching operation performed before the forming of the ribs.

18. A panel as claimed in claim 16 wherein the woven scrim is formed of polypropylene fibers.

19. A panel as claimed in claim 13 wherein the fibers are polypropylene fibers.

* * * * *